US008161882B2

(12) United States Patent
Pfersmann et al.

(10) Patent No.: US 8,161,882 B2
(45) Date of Patent: Apr. 24, 2012

(54) PROPELLANT CHARGE

(75) Inventors: Axel Pfersmann, Feucht (DE); Alfred Eckel, Roethenbach (DE)

(73) Assignee: Diehl BGT Defense GmbH & Co. KG, Ueberlingen (DE)

( * ) Notice: Subject to any disclaimer, the term of this patent is extended or adjusted under 35 U.S.C. 154(b) by 4 days.

(21) Appl. No.: 12/959,612

(22) Filed: Dec. 3, 2010

(65) Prior Publication Data

US 2011/0072996 A1 Mar. 31, 2011

Related U.S. Application Data

(63) Continuation of application No. PCT/EP2009/003695, filed on May 26, 2009.

(30) Foreign Application Priority Data

Jun. 3, 2008 (DE) ..... 10 2008 026 645

(51) Int. Cl.
*F42B 5/30* (2006.01)
*F42B 5/38* (2006.01)

(52) U.S. Cl. ..... 102/282; 102/466

(58) Field of Classification Search ..... 102/466, 102/282, 449, 467, 431
See application file for complete search history.

(56) References Cited

U.S. PATENT DOCUMENTS 2,862,446 A * 12/1958 Ringdal ..... 102/430
3,144,827 A * 8/1964 Boutwell ..... 102/466
3,435,765 A * 4/1969 Gawlick et al. ..... 102/531
3,459,098 A 8/1969 Donnelly
3,609,904 A * 10/1971 Scanlon ..... 42/76.01
3,760,729 A * 9/1973 Freeman ..... 102/346
3,882,778 A * 5/1975 Gawlick et al. ..... 102/530
4,593,622 A * 6/1986 Fibranz ..... 102/530
4,644,865 A 2/1987 Lawrence
4,949,640 A * 8/1990 Reinelt ..... 102/282
5,233,928 A 8/1993 Ducros et al.
5,492,064 A 2/1996 Boutet
5,670,735 A 9/1997 Ortmann et al.
5,708,231 A 1/1998 Koon
6,012,394 A 1/2000 Dion et al.
6,752,084 B1 * 6/2004 Husseini et al. ..... 102/466
(Continued)

FOREIGN PATENT DOCUMENTS

DE 1184245 B 12/1964
(Continued)

OTHER PUBLICATIONS

International Search Report dated Sep. 22, 2009.

*Primary Examiner* — James Bergin
(74) *Attorney, Agent, or Firm* — Laurence A. Greenberg; Werner H. Stemer; Ralph E. Locher

(57) ABSTRACT

A propellant charge for use for ammunition, in which the propellant charge is separate from the projectile, has a propellant charge substance which can be initiated by a fuse. In order to solve the problem of providing a propellant charge for use in a two-part munition, which on the one hand can be produced easily and at low cost and on the other hand does not present any risk of damage when mechanically loaded before use, it is proposed that a propellant charge casing be provided which surrounds the propellant charge substance, with the propellant charge casing being in the form of a plastic part which is composed of a non-combustible, temperature-stable plastic material.

15 Claims, 1 Drawing Sheet

U.S. PATENT DOCUMENTS 7,461,597 B2 * 12/2008 Brunn ..... 102/463

FOREIGN PATENT DOCUMENTS

| | | | |
|---|---|---|---|
| DE | 1919954 | A1 | 2/1972 |
| DE | 2205619 | A1 | 8/1972 |
| DE | 3344369 | A1 | 6/1985 |
| DE | 4223735 | A1 | 1/1994 |
| DE | 69209583 | T2 | 9/1996 |
| DE | 69811142 | T2 | 7/2003 |
| DE | 102004039761 | B4 | 10/2006 |
| DE | 102005011759 | B4 | 10/2006 |
| EP | 0718591 | A2 | 6/1996 |
| FR | 2763392 | A1 | 11/1998 |
| GB | 1161422 | A | 8/1969 |

* cited by examiner

PROPELLANT CHARGE

CROSS-REFERENCE TO RELATED APPLICATION

This is a continuation application, under 35 U.S.C. §120, of copending international application No. PCT/EP2009/003695, filed May 26, 2009, which designated the United States; this application also claims the priority, under 35 U.S.C. §119, of German patent application No. DE 10 2008 026 645.0, filed Jun. 3, 2008; the prior applications are herewith incorporated by reference in their entirety.

BACKGROUND OF THE INVENTION

Field of the Invention

The present invention relates to a propellant charge for use for ammunition, in which the propellant charge is separate from the projectile, having a propellant charge substance which can be initiated by a fuse.

In this type of munition, the propellant charge is separate from the projectile, in order to ensure that the total weight of the munition is reduced in comparison to traditional, cased ammunition. In the case of the latter, approximately 50% of the total weight of the munition is made up by the casing which encloses the propellant charge substance but is useless for the propulsion effect of the projectile. In order to reduce this useless component of the weight to 0%, a two-part munition was developed in the past, in which the propellant charge is in the form of a pressed powder body without a casing, which burns when a shot is fired, without any residue.

A powder body such as this is known from German patent DE 10 2004 039 761 B4. This is a powder body for caseless ammunition for use in automatically firing weapons, in particular small-calibre and medium-calibre weapons. The powder body is in the form of an extruded powder pressed body with a multiplicity of channels which run through the powder body. Since the powder body has to be sufficiently mechanically robust to ensure that it cannot be damaged even before use when loaded mechanically, its manufacture is extremely difficult.

So-called shotgun cartridges are also known from the prior art, in which the propellant charge substance is accommodated together with the projectile (shot pellets) in a high-temperature-resistant plastic casing. The bottom area of the shotgun cartridge has a metal cap which holds the plastic casing.

SUMMARY OF THE INVENTION

It is accordingly an object of the invention to provide a propellant charge which overcomes the above-mentioned disadvantages of the prior art devices of this general type, which propellant charge is used in a two-part munition, which on the one hand can be produced easily and at low cost, while on the other hand does not present any risk of damage when mechanically loaded before use.

With the foregoing and other objects in view there is provided, in accordance with the invention a propellant charge for use for ammunition, in which the propellant charge is separate from a projectile. The propellant charge contains a propellant charge substance which can be initiated by a fuse, and a propellant charge casing surrounding the propellant charge substance. At least a majority of the propellant charge casing is a plastic part composed of a non-combustible, temperature-stable plastic material.

In the case of the propellant charge of this generic type, this problem is solved in that, instead of a pressed body, a propellant charge casing is provided which surrounds the propellant charge substance, at least the majority of the propellant charge casing being provided as a plastic part which is composed of a non-combustible, temperature-stable plastic material. The use of a propellant charge casing composed of high-temperature-resistant plastic on the one hand makes it possible to introduce the propellant charge substance in a loosely poured form, which can be achieved in a very simple manner from the production engineering point of view. On the other hand, because of the comparatively low weight of the plastic, the propellant charge has a low weight, as before. The munition is therefore easy to handle and is at the same time damage-resistant. The propellant charge casing can be produced in a simple manner by the so-called injection-molding process, and therefore has considerable manufacturing advantages, and thus cost advantages, in comparison to the prior art.

An opening which is closed by a closure cover, is provided on the end face of the propellant charge casing opposite the firing element. When the propellant charge is fired, the charge escapes, directed through the opening, in the direction of the projectile.

To this end, the closure cover is expediently formed from a combustible material such that it burns away when the charge is fired, thus releasing the exit from the propellant charge casing.

Weak points are expediently provided in the closure cover, initiating a defined breaking-up behavior when the charge is fired, as a result of the pressure that is created in the process, therefore making it possible to achieve defined destruction and, as a consequence of this, controlled combustion of the closure cover and of the components thereof.

The propellant charge substance can advantageously be poured within the propellant charge casing in such a way that, from the production-engineering point of view, filling of the propellant charge can be carried out extremely easily.

Furthermore, a recess, which is preferably already formed in the bottom area of the propellant charge casing, can be provided in the end-face area of the propellant charge, which is opposite the closure cover, in order to hold an initiation element. There is therefore no need to use an additional metal base for holding the initiation element, as is the case, for example, in a shotgun cartridge.

The strength of the plastic part can expediently be increased by reinforcement, for example reinforcement by additional fiber material, for example staple fibers composed of glass. A strength-increasing measure such as this can also be provided in particular just in one subarea of the plastic part, expediently in its bottom area, where the propellant charge casing interacts with the weapon seal.

If a plastic is used with a softening point ($T_{softening} \geqq 230°$ C.), preferably with a softening point ($T_{softening} \geqq 250°$ C.), this reliably prevents the propellant charge casing from sticking to the wall of the weapon-side holder.

The plastic for production of the propellant charge casing can expediently be chosen from the group of thermosetting plastics. However, it is also possible to use a plastic from the group of thermoplastics, provided that this has a sufficiently high softening point.

A profile or at least a shaped wall is expediently formed in the bottom area of the propellant charge casing and interacts with a seal which is provided on the weapon side, such that the sealing effect is achieved by interaction of the propellant charge casing with the seal which is provided on the weapon side.

The propellant charge casing can advantageously be formed integrally per se, that is to say created in a single production step.

Other features which are considered as characteristic for the invention are set forth in the appended claims.

Although the invention is illustrated and described herein as embodied in a propellant charge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
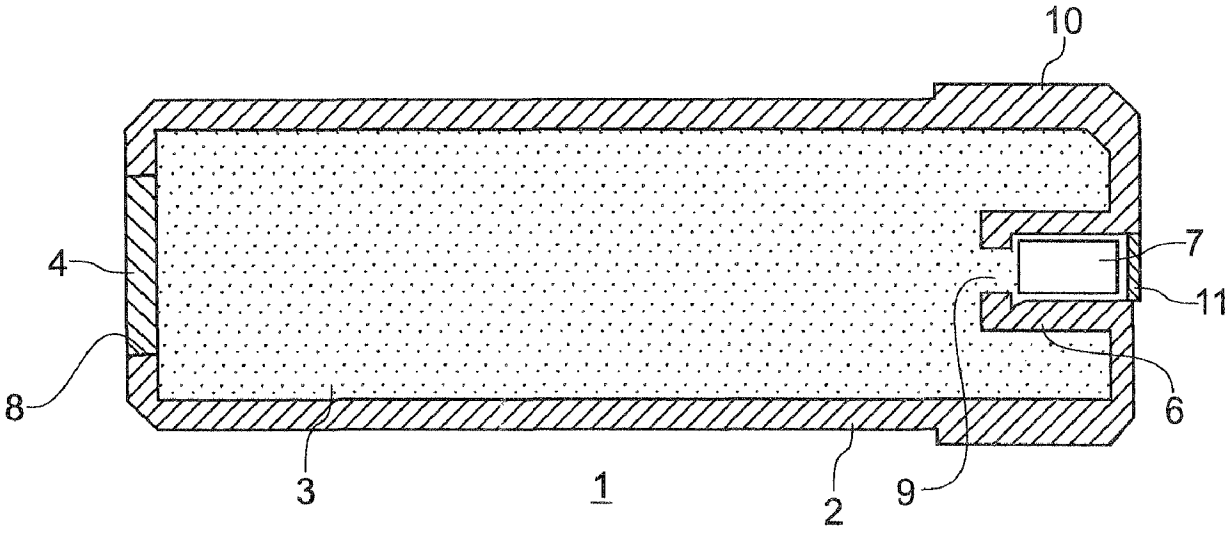
FIG. 1 is a diagrammatic, cross-sectional view along a longitudinal profile of one embodiment of a propellant charge according to the invention.

Referring now to the figures of the drawing in detail and first, particularly, to FIG. 1 thereof, there is shown a propellant charge 1 per se. This is a propellant charge without a projectile as a component of a two-part munition which is used predominantly for automatic weapons, such as machine guns or automatic cannons. The round or projectile in this type of munition is provided as a separate part, that is to say it is not a component of the propellant charge.

The propellant charge 1 has a propellant charge casing 2 in the form of an, in particular, integral plastic moulding. A propellant charge substance 3 is located in the interior of the propellant charge casing 2, for example in the form of a loosely poured powder. In its right-hand end area in FIG. 1, the propellant charge casing 2 has a recess 6 which, in particular, is formed in the plastic molding, with an aperture 9 for holding a conventional initiation element 7. The initiation element 7 may be either a mechanical or electrical initiation element. The initiation element 7 is held within the recess 6 by a cover 11 which may also be an integral component of the initiation element 7.

Wall areas 10 which interact with a weapon-side seal (which is not illustrated in the drawing figures) are provided in the area of the rearward end, on the right in FIG. 1, of the propellant charge casing 2.

The propellant charge casing 2 is preferably formed integrally as a plastic injection-molded part. As a plastic, a plastic is provided which has a softening temperature ($T_{softening} \geqq 230°$ C.), preferably a softening temperature ($T_{softening} \geqq 250°$ C.). A plastic from the group of thermosetting plastics is very particularly suitable for use as the plastic. However, it is also apparently possible to use a plastic from the group of thermoplastics, provided that its softening temperature is high enough.

An opening 8 on the end face opposite the initiation element 7 in the propellant charge casing 2 is closed by a closure cover 4. The closure cover 4 is composed of a material which preferably burns away without leaving any residue, for example cardboard or the like. The closure cover 4 can be attached to the plastic molding by a suitable connection technique, for example clamping, latching connection or the like.

As already mentioned initially, the propellant charge casing 2 is composed of high-temperature-resistant plastic so that, when the propellant charge 1 is fired, the propellant charge casing 2 cannot become firmly stuck, as a result of melting, to the weapon-side holding area.

In order to increase the strength of the propellant charge casing 2 even further, the plastic may have a reinforcement (which is not illustrated in the figures), for example glass-fiber reinforcement by stable fibers or the like. Accordingly, reinforcement measures such as these may be provided in particular in the area of the propellant charge casing 2 which is associated with the initiation element 7 and is mechanically relatively highly loaded.

With regard to the seal at the rear, that is to say in the opposite direction to the firing direction, the seal is provided by the interaction of wall pieces 10 of the propellant charge casing 2 with a non-illustrated seal which is provided on the weapon side.

Figure 2:
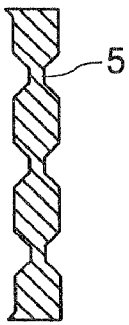
FIG. 2 is a sectional view of one particular embodiment of a closure cover with weak points.

As is also shown in FIG. 2, one particular embodiment of the closure cover 4 may have individual weak points 5 which are used to ensure a defined break-up behavior on firing of the propellant charge substance 3, and thus to ensure that the closure cover fragments burn up in a controlled manner.

The present invention allows a propellant charge configuration which can be implemented technically easily, is light in weight, and has low production costs with high effectiveness.

The invention claimed is:

1. A propellant charge for use for ammunition, in which the propellant charge is separate from a projectile, the propellant charge comprising:

a propellant charge substance which can be initiated by means of a fuse; and a propellant charge casing surrounding said propellant charge substance, at least a majority of said propellant charge casing being a plastic part composed of a temperature-stable plastic material having a softening point ($T_{softening} \geqq 230°$ C.);

said propellant charge substance being a loosely poured powder held in said propellant charge casing; and said propellant charge casing and said propellant charge substance forming one part of a two-part munition.

2. The propellant charge according to claim 1, further comprising a closure cover and said propellant charge casing having an opening formed therein being closed by said closure cover.

3. The propellant charge according to claim 2, wherein said closure cover is composed of a combustible material.

4. The propellant charge according to claim 2, wherein said closure cover has weak points formed therein.

5. The propellant charge according to claim 1, wherein said propellant charge substance is poured within said propellant charge casing.

6. The propellant charge according to claim 1, further comprising a firing element, said propellant charge casing having a bottom area with a recess formed therein for receiving said firing element.

7. The propellant charge according to claim 1, wherein said plastic part has a strength-increasing reinforcement.

8. The propellant charge according to claim 1, wherein said plastic part is made from a plastic from selected from the group consisting of thermosetting plastics.

9. The propellant charge according to claim 1, wherein said propellant charge has a bottom area formed with wall pieces and said wall pieces interact with a seal provided on a weapon side.

10. The propellant charge according to claim 1, wherein said propellant charge casing is formed integrally.

11. The propellant charge according to claim 1, wherein said temperature-stable plastic material has a softening point ($T_{softening} \geqq 250°$ C.).

12. The propellant charge according to claim 1, wherein said propellant charge casing is a one-piece unit.

13. The propellant charge according to claim 1, wherein said propellant charge casing is configured to be inserted into a machine gun and said propellant charge substance is configured to be ignited by a machine gun.

14. A method of propelling a projectile from an automatic weapon, which comprises:

obtaining a propellant charge for use for ammunition, in which the propellant charge is separate from a projectile, the propellant charge including a propellant charge substance which can be initiated by means of a fuse, and a propellant charge casing surrounding the propellant charge substance, at least a majority of the propellant charge casing being a plastic part composed of a temperature-stable plastic material having a softening point ($T_{softening} \geqq 230°$ C.), the propellant charge substance being a loosely poured powder held in the propellant charge casing, and the propellant charge casing and the propellant charge substance forming one part of a two-part munition; and igniting the propellant charge substance to propel the projectile from the automatic weapon.

15. The method according to claim 14, wherein the automatic weapon is a machine gun.

* * * * *